US005305626A

United States Patent [19]

Tiekink

[11] Patent Number: 5,305,626

[45] Date of Patent: Apr. 26, 1994

[54] EXTRUSION METHOD AND EXTRUSION APPARATUS

[75] Inventor: Jozef J. Tiekink, Harderwijk, Netherlands

[73] Assignee: Reynolds Aluminium Holland B.V., KH Harderwijk, Netherlands

[21] Appl. No.: 7,734

[22] Filed: Jan. 22, 1993

[30] Foreign Application Priority Data

Jan. 24, 1992 [NL] Netherlands ..... 9200138

[51] Int. Cl.[5] ..... B21C 35/00

[52] U.S. Cl. ..... 72/257; 72/260

[58] Field of Search ..... 72/254, 255, 257, 260, 72/169

[56] References Cited

U.S. PATENT DOCUMENTS

| | | | |
|---|---|---|---|
| 1,789,675 | 1/1931 | Elias | 72/260 |
| 1,916,645 | 10/1932 | Tayler . | |
| 3,175,381 | 3/1965 | Hawkins et al. | 72/255 |
| 4,817,411 | 4/1989 | Bennett et al. | 72/255 |

FOREIGN PATENT DOCUMENTS

| | | |
|---|---|---|
| 438914 | 12/1926 | Fed. Rep. of Germany . |
| 2650496 | 5/1978 | Fed. Rep. of Germany . |
| 2855449 | 7/1980 | Fed. Rep. of Germany . |
| 58-184012 | 10/1983 | Japan . |

*Primary Examiner*—Lowell A. Larson
*Attorney, Agent, or Firm*—Bachman & LaPointe

[57] ABSTRACT

The invention relates to a method and an apparatus for extruding sections from materials, such as aluminium or aluminium alloys, in which material which has been rendered plastic is forced through an extrusion gap formed in a die and in which the extrusion gap is bounded by separate, mutually oppositely situated running surfaces, in which method, as a consequence of the shape and/or length of the running surfaces and/or width of the extrusion gap, the material forced through the extrusion gap experiences a lower resistance at one side of the die than at the other side of the die, more material being forced through the extrusion gap at said one side than at said other side, a curved section being formed as a result of the difference in the amount of material at the one side and at the other side, the longitudinal axis of said section having a curvature with a certain radius. The longitudinally curved section emerging from the die is passed through a curved guide device after leaving the die, the curvature of the guide device essentially matching the curvature of the curved section. After emerging from the die, the section is cooled, after which it is clamped by gripping means and is pulled by the latter in such a way that the rate at which the section is extruded is kept essentially constant.

10 Claims, 3 Drawing Sheets

Figure 1:
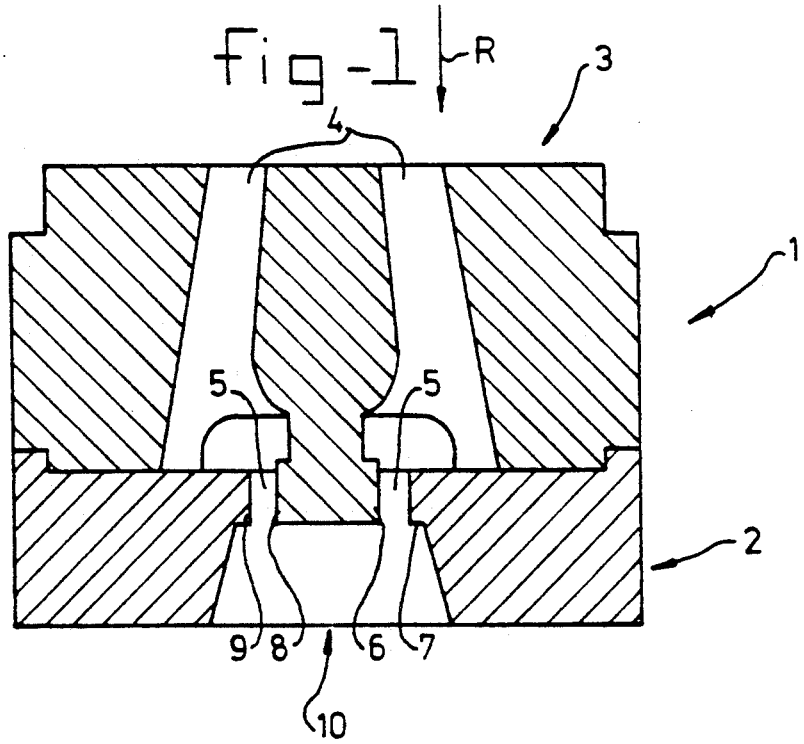

R
3
4
1
5
5
2
9
8
6
7
10

EXTRUSION METHOD AND EXTRUSION APPARATUS

The invention relates in the first instance to a method of extruding sections from materials, such as aluminium or aluminium alloys, in which material which has been rendered plastic is forced through an extrusion gap formed in a die and in which the extrusion gap is bounded by separate, mutually oppositely situated running surfaces.

Such a method is generally known and is frequently used for manufacturing, for example, aluminium sections. To obtain curved sections, the sections are bent after extrusion with the aid of a bending device. This bending is very time-consuming and labour-intensive, and consequently expensive. In addition, the bending achievable as a maximum is limited by the material stresses permitted as a maximum. In particular, in the case of hard alloys, such as aluminium 7000, the bending possibilities are limited. Moreover, to bend sections having thin walls, guides have to be used to prevent upsetting. In the case of open sections, such as U-sections, this is not so difficult, but in the case of hollow sections, such as box girders, this is very troublesome. The bending of sections with dividing walls is even more troublesome.

The object of the present invention is to avoid the abovementioned problems in bending sections.

This object is achieved by providing a method in which, as a consequence of the shape and/or length of the running surfaces and/or the width of the extrusion gap, the material forced through the extrusion gap experiences a lower resistance at one side of the die than at the other side of the die, and in which more material is forced through the extrusion gap at said one side than at said other side of the die, and in which a curved section is formed as a result of the difference in the amount of material at the one side and the other side, the longitudinal axis of said section having a curvature with a certain radius.

In this way, a curved section can be manufactured which has a homogeneous material quality, the section not having any internal stresses in the curved state. Hollow curved sections, such as box sections can readily be manufactured in this way. Moreover, an identical wall thickness can easily be given at all points to the section to be formed. Optionally, if allowance is made for the material stresses permitted as a maximum, the already curved section can be bent still further, with the result that a still more marked curvature can be achieved than previously.

Preferably, the longitudinally curved section emerging from the die is passed through a curved guide device after leaving the die, the curvature of the guide device essentially matching the curvature of the curved section.

Furthermore, it is advantageous, according to the invention, if the curved section is cooled. In this way, damage is prevented since the section is less susceptible to outside influences, such as the action on it of parts of the guide device. Such an action of the parts of the guide device on the section readily takes place in the case of a curved guide path.

According to a further advantageous method according to the invention, the curved section is clamped by gripping means after cooling and is pulled by said gripping means in such a way that the rate at which the section is extruded is kept essentially constant. When sections are extruded, the mass, to be displaced, of the extruded section which has emerged from the die, and the resistance which said mass experiences, for example, from the guide path, increases with the length of the extruded section. In the extrusion of straight sections, this does not generally cause any problem. However, when curved sections are extruded, said mass and resistance result in forces and torques which act on the section formed and which affect the curvature of the section. As a result, it becomes very difficult, in particular in the case of fairly long sections and/or sections with very marked curvatures, to ensure a desired, for example constant, curvature of the section. By clamping the section formed and then pulling it, it is possible to compensate for said mass and resistance which increase with the length of the section formed, as a result of which the formed part of the section emerging from the die can be held, as it were, weightless. Said compensation is achieved by means of drive means which advance the gripping means (for example pull or push them) in such a way that the extrusion rate of the section formed remains essentially constant. In this connection, extrusion rate is understood as meaning the longitudinal speed of the section being formed, that is to say the speed of the section in the direction of the curved longitudinal axis. Cooling the section before gripping it prevents the gripping means deforming it.

According to yet another advantageous method, the section emerging from the die is divided into pieces of desired length by a dividing device which moves concomitantly with the gripping means.

The invention also relates to an apparatus for carrying out the method, and said apparatus comprises a die having an extrusion gap which is formed therein and is bounded by separate, mutually oppositely situated running surfaces. According to the invention, the shape and/or length of the running surfaces and/or the width of the extrusion gap is such that the material to be forced through the extrusion gap will experience less resistance at one side of the die than at the other side of the die, with the result that the material forced through the extrusion gap of said die forms a curved section.

Preferably, an apparatus for applying the method according to the invention furthermore comprises a guide unit for the section emerging from the die, said guide unit having the characteristic that if forms a curved guide path which essentially matches the curvature of the curved section and which is provided with rollers and/or graphite blocks.

In accordance with a preferred embodiment according to the invention, the guide path comprises a cooling device. Such a cooling device may be mounted, for example, at the start of the guide path, immediately downstream of the die, but also anywhere else in the guide path.

In accordance with a further preferred embodiment according to the invention, the guide path furthermore comprises a clamping device for gripping the curved section and drive means for pulling the curved section at an essentially constant speed by means of the clamping device. Such a clamping device comprises, for example, two claws which are pivotally linked to one another and which precisely enclose the section in the closed state (i.e. the clamp interlocks with the section in a shape-fitting manner), with the result that, given sufficient clamping force, an optimum grip is obtained. Preferably, the contact faces of such claws are coated with graphite.

According to a further preferred embodiment, the apparatus according to the invention comprises a dividing device, such as a saw, which is coupled to the clamping device in such a manner that the dividing device moves concomitantly with the clamping device. Preferably, the clamping device comprises two pairs of claws between which a saw is mounted. The saw and claw pairs may in this case be mounted on a common frame, the saw sawing through the section during the pulling.

With the method and apparatus according to the invention, very complex, curved, either hollow or open sections can be manufactured. These sections can be manufactured from many materials, even strong metal alloys (so-called "hard alloys"), such as aluminium 7000. Very strongly curved, and also gently curved, sections can be produced. The apparatus and method according to the invention are, inter alia, very suitable for manufacturing car bumpers.

Figure 2A:
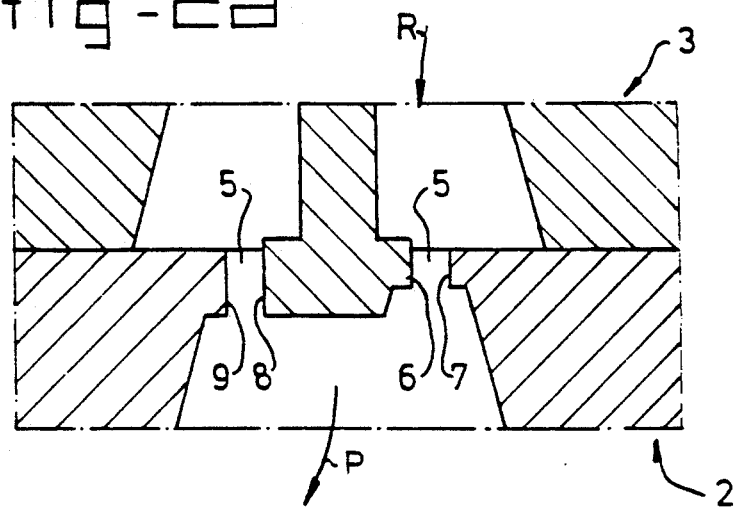
Figure 2B:
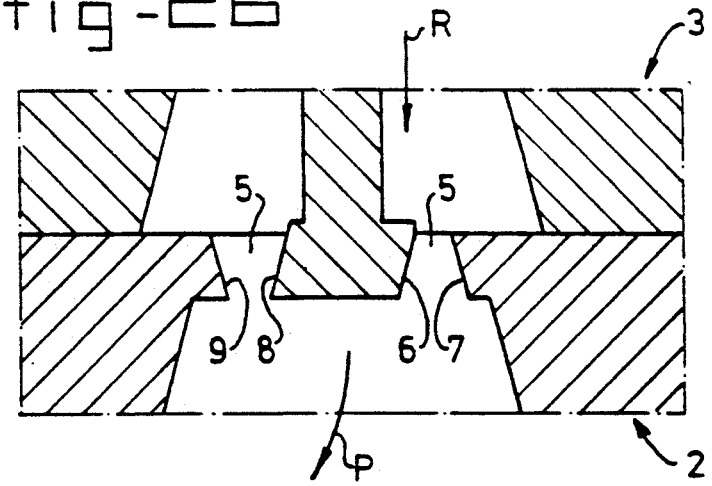
Figure 2:
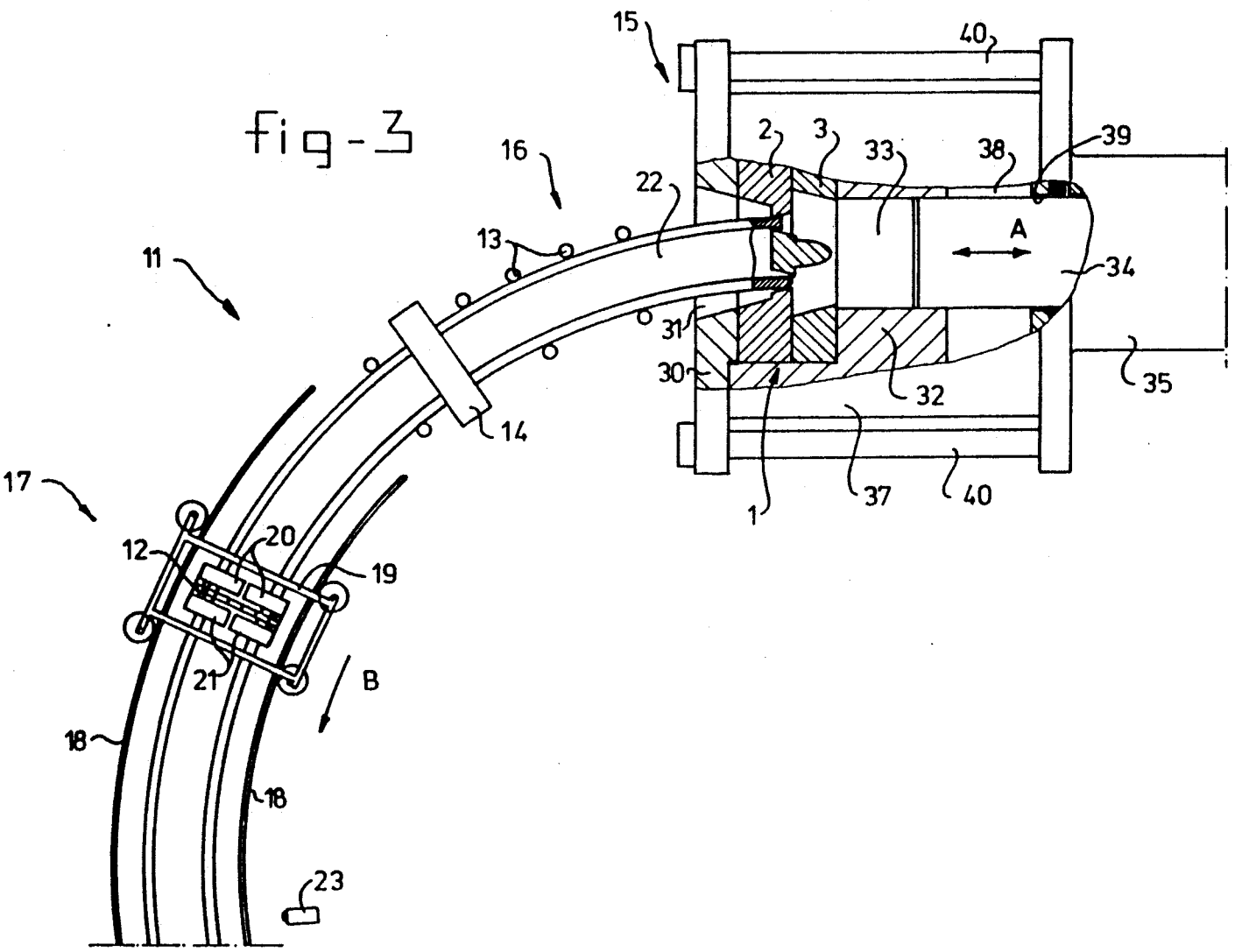

The invention will be explained in greater detail below by means of an example with reference to some drawings. In the drawings:

FIG. 1 shows a section through an extrusion die,

FIG. 2*a* shows a detail of FIG. 1, in which an example of running surfaces formed according to the invention is given, FIG. 2*b* shows a detail of FIG. 1, in which another example of running surfaces formed according to the invention is given, and FIG. 3 shows a diagrammatic plan view of an extrusion press apparatus, a die and a curved guide device according to the invention.

FIG. 1 shows a section through a die 1 for a hollow box section, which die comprises a moulding part 2 for the outside of the section and a moulding part 3 for the inside of the section. Arrow R indicates the pressing direction from which the plastic material is forced into the die 1.

The plastic material is forced via the feed opening 4 in the inside moulding part 3 towards the extrusion gap 5, which extrusion gap 5 is bounded by mutually oppositely situated running surfaces 6, 8 or 7, 9, respectively, mounted on both moulding parts 2 and 3. The running surfaces 6 and 8 for the inside of the section are mounted on a projecting portion of the inside shaped part 3. The running surfaces 7 and 9 for the outside of the section are mounted on the outside moulding part 2.

When the plastic material has been forced along the running surfaces 6, 7, 8 and 9, the shaped section is able to leave the die 1 unimpeded as a consequence of the widening of the exit opening 10 in the outside moulding part 2.

The running surfaces 6, 7, 8 and 9 are designed in such a way that the plastic material forced through the extrusion gap experiences a lower resistance at one side of the die than at the other side. Consequently, more material is forced through the gap at one side of the die than at the other side. With correct dimensioning of the extrusion gap size, the running surface shape and/or running surface length, this additional material will be absorbed in a greater length of the section. The result is a curved section.

The resistance which the material forced through the extrusion gap experiences from the running surfaces may, for example, be influenced by adjusting the length of the running surfaces in the pressing direction (arrow R) and/or by adjusting the position of the guide surfaces of the running surfaces and/or by varying the width of the extrusion gap.

FIG. 2*a* shows, in a detail of FIG. 1, an example of the influencing of the resistance by adjusting the lengths of the running surfaces 6, 7, 8 and 9. The lengths, seen in the pressing direction R, of the running surface 6 and 7 are in this case less than those of the running surface 8 and 9, respectively. The plastic material will experience less resistance in the extrusion gap 5 in passing between running surfaces 6 and 7 than in passing between running surfaces 8 and 9. Since the passage widths, viewed in the direction perpendicular to the arrow R, between the two running surface pairs 6, 7 and 8, 9 are equal, the section emerging from the die will have a curvature as shown by arrow P.

FIG. 2*b* shows, in a detail of FIG. 1, another example of the influencing of the resistance. In this case, the position of the guide surfaces of the running surfaces 6, 7, 8 and 9 is adjusted. Here, again, the plastic material will experience less resistance on passing between running surfaces 6 and 7 than on passing between running surfaces 8 and 9, with the result that the section emerging from the die will again have a curvature as shown by arrow P.

It is pointed out that, according to the principle of the invention, it is obvious to form the running surfaces in the portions of the extrusion gap which are not shown in such a way that the resistance which the material forced through the extrusion gap experiences varies gradually on passing from one side of the die to the other.

It is furthermore pointed out that, according to the invention, yet other shapes and/or lengths of the running surfaces are conceivable for producing the same effect, namely curvature of the section. Differences in width of the extrusion gaps, and consequently wall thickness differences, may also produce, according to the invention, a curvature of the section. Furthermore, according to the invention, the curvature of the section can also be produced by feeding more material to one side of the die than to the other side.

FIG. 3 shows diagrammatically an extrusion press apparatus 15 having a curved guide path 11.

The extrusion press apparatus 15 comprises a rear housing part 35 which encloses a rear chamber, a front housing part 37 which encloses a prechamber 38 and in which a holder 32 for a piece ("billet") of metal 33, such as aluminium, and the die 1 with inside moulding part 3 and outside moulding part 2 are mounted, and a plate 30 for clamping the die 1 in the front housing 37. The rear housing 35, front housing 37 and plate 30 are attached to one another by means of clamping means 40. Plate 30 is provided with an opening 31 which widens outwards, said widening being such that a curved section 22 can pass through it. A piece of metal 33 ("billet") which may be forced through the die 1 to form a curved section 22 by means of a press 34 which can be moved to and fro as shown by double arrow A may be placed in the holder 32. In this connection, the press 34 can be moved to and fro by means of a generally standard drive, which is not shown, over its guides 39 between the rear chamber and prechamber 38.

The curved section 22 emerging from the die 2, 3 is guided away with the aid of a correspondingly curved guide path 11. Here the curved section 22 is first guided through a first fixed part 16 of the path preferably having guide rollers or graphite blocks 13 on either side of the section 22 and is cooled in the meantime by a cooling device 14. The first part 16 of the path merges into a second, likewise curved part 17 of the path having rails 18 over which a carriage 19 can be moved to and fro. Said carriage 19 comprises two pairs of parallel clamps 20 and 21 between which a saw 12 is mounted. At the same time, the clamps 20 and 21 are preferably formed in such a manner that they are able to clamp the section 22 in a shape-fitting manner. Furthermore, the carriage 19 is provided with a drive which is not shown and which is capable of advancing the carriage in the direction of arrow B. In this connection, said drive for the carriage 19 provides a force which is such that the section emerging from the die is, as it were, held weightlessly with the result that, on balance, no forces or torques which are disadvantageous for the curvature act on the curved section.

The operation of the carriage 19 with clamps 20, 21 and saw 12 is as follows. The carriage 19 is located at the end of the first part 16 of the path where the clamps 20, 21 are closed around the section moving in the direction of the arrow B. During the closure, the carriage 19 is pulled or pushed in the direction of the arrow B with the same speed as that with which the section emerges from the die 1. As soon as the clamps 20, 21 have closed, the carriage 19 pulls the section, as it were, along the rails 18, in which process the "pulling force" of the carriage compensates for the forces and torques which are disadvantageous for the curvature of the section. While the carriage 19 pulls the section clamped thereon, the section is sawn through by the saw mounted on the carriage between the clamps 20, 21. As soon as the sensor 23 detects the arrival of the carriage 19, the clamps 20, 21 release the section and the sawn-off piece of the section is removed by conveyance means which are not shown. The carriage 19 is then taken back along the rails 18 to the end of the first part 16 of the path. At the end of the first part 16 of the path, the clamps are closed again, after which the entire process is repeated. It will be clear that, during the process described above, the extrusion of the section is able to take place continuously without it having to be interrupted.

It will furthermore be clear that many variations on the guide device described above are conceivable. The first part 16 of the path may, for example, be very short or, possibly, omitted altogether. The cooling device 14 may be mounted at many points between extrusion device and carriage. The curvature of the guide path is dependent on the desired section curvature.

The shapes of the die and of the shape-fitting clamps will depend on the desired shape of the section.

I claim:

1. A method for extruding curved sections from a material which has been rendered plastic comprising:

providing an extrusion die having first and second extrusion gaps;

sizing the first and second extrusion gaps so as to provide different resistances for plastic material forced therethrough;

forcing the plastic material through the first and second extrusion gaps so as to form a curved extruded section having a radius of curvature;

gripping said curved extruded section; and pulling said curved extruded section along a predetermined curved path having a radius of curvature substantially equal to the radius of curvature of the curved extruded section emerging from the die so as to form a curved section of constant curvature.

2. A method according to claim 1 wherein said material is selected from the group consisting of aluminum and aluminum alloys.

3. A method according to claim 1 including cooling said curved extruded section prior to gripping.

4. A method according to claim 1 including cutting said curved extruded section into predetermined lengths.

5. A method according to claim 4 including providing gripping means and cutting means wherein the cutting means moves concomitantly with the gripping means during the pulling of said curved extruded section.

6. An apparatus for extruding curved sections from a material which has been rendered plastic comprising:

an extrusion die having first extrusion gap means formed in said extrusion die for providing a first resistance to a plastic material forced therethrough; and second extrusion gap means formed in said extrusion die for providing a second resistance to the plastic material forced therethrough which is different from the first resistance whereby a curved extruded section having a radius of curvature is formed when the first material is forced through the extrusion die; and means for gripping and pulling the curved extruded section along a predetermined curved path having a radius of curvature substantially equal to the radius of curvature of the curved extruded section emerging from the die, so as to form a curved section of constant curvature.

7. An apparatus according to claim 6 wherein said material is selected from the group consisting of aluminum and aluminum alloys.

8. An apparatus according to claim 6 including cooling means between said extrusion die and said gripping means for cooling said curved extruded section prior to gripping.

9. An apparatus according to claim 6 including cutting means for cutting said curved extruded section.

10. An apparatus according to claim 9 wherein said cutting means and said gripping means are mounted on carriage means and move concomitantly during the pulling of said curved section.

* * * * *

UNITED STATES PATENT AND TRADEMARK OFFICE

CERTIFICATE OF CORRECTION

PATENT NO. : 5,305,626
DATED : April 26, 1994
INVENTOR(S) : Jozef Jan Tiekink

It is certified that error appears in the above-indentified patent and that said Letters Patent is hereby corrected as shown below:

On the cover page under the Foreign Application Priority Data, insert the second priority application as follows:
--January 19, 1993 [NL] Netherlands.....9300097--

Signed and Sealed this
Twenty-fifth Day of July, 1995

*Attest:*

*Attesting Officer*

BRUCE LEHMAN

*Commissioner of Patents and Trademarks*